US008128310B2

(12) United States Patent
Dindl et al.

(10) Patent No.: US 8,128,310 B2
(45) Date of Patent: Mar. 6, 2012

(54) VEHICLE RESTRAINT SYSTEM

(75) Inventors: Frank J. Dindl, Newton, NJ (US); Kenneth R. Jones, Wayne, NJ (US); Christopher J. Strianse, Pompton Plains, NJ (US)

(73) Assignee: Unified Designs, Inc., Rockaway, NJ (US)

( * ) Notice: Subject to any disclaimer, the term of this patent is extended or adjusted under 35 U.S.C. 154(b) by 177 days.

(21) Appl. No.: 12/719,073

(22) Filed: Mar. 8, 2010

(65) Prior Publication Data

US 2011/0076097 A1 Mar. 31, 2011

Related U.S. Application Data

(60) Provisional application No. 61/246,954, filed on Sep. 29, 2009.

(51) Int. Cl.
*E01F 15/06* (2006.01)

(52) U.S. Cl. ..... 404/6; 404/9; 404/10

(58) Field of Classification Search ..... 404/6, 9–11; 256/13.1

See application file for complete search history.

(56) References Cited

U.S. PATENT DOCUMENTS

| | | | | | |
|---|---|---|---|---|---|
| 4,004,857 | A * | 1/1977 | Eschen, Jr. | ..... | 404/6 |
| 4,203,685 | A * | 5/1980 | Sanchez | ..... | 404/6 |
| 4,318,079 | A * | 3/1982 | Dickinson | ..... | 404/6 |
| 4,367,975 | A * | 1/1983 | Tyers | ..... | 404/6 |
| 4,600,335 | A * | 7/1986 | Truglio | ..... | 404/6 |
| 4,708,515 | A * | 11/1987 | Davies | ..... | 404/6 |
| 4,775,261 | A * | 10/1988 | Fladung | ..... | 404/6 |
| 4,828,424 | A * | 5/1989 | Crisp, Sr. | ..... | 404/6 |
| 4,916,859 | A * | 4/1990 | Butler | ..... | 49/9 |
| 4,998,843 | A * | 3/1991 | Mothe | ..... | 404/6 |
| 5,009,542 | A * | 4/1991 | Hardin et al. | ..... | 404/6 |
| 5,509,753 | A * | 4/1996 | Thompson | ..... | 404/6 |
| 5,762,443 | A * | 6/1998 | Gelfand et al. | ..... | 404/6 |
| 6,062,765 | A * | 5/2000 | Dotson | ..... | 404/6 |
| 6,142,702 | A * | 11/2000 | Simmons | ..... | 404/6 |
| 6,485,225 | B1 * | 11/2002 | Baker | ..... | 404/6 |
| 7,101,112 | B2 * | 9/2006 | Burns et al. | ..... | 404/6 |
| 7,114,873 | B2 * | 10/2006 | Rastegar et al. | ..... | 404/6 |
| 7,320,557 | B1 * | 1/2008 | Potter | ..... | 404/6 |
| 7,530,759 | B2 * | 5/2009 | Gelfand et al. | ..... | 404/10 |
| 7,563,051 | B2 * | 7/2009 | Buckley et al. | ..... | 404/6 |
| 7,581,351 | B2 * | 9/2009 | Lewis | ..... | 49/49 |
| 7,641,416 | B2 * | 1/2010 | Miracle | ..... | 404/6 |
| 7,845,877 | B2 * | 12/2010 | Gelfand et al. | ..... | 404/6 |
| 7,866,912 | B2 * | 1/2011 | Gelfand et al. | ..... | 404/6 |
| 8,016,513 | B2 * | 9/2011 | Shin | ..... | 404/6 |

* cited by examiner

*Primary Examiner* — Raymond W Addie
(74) *Attorney, Agent, or Firm* — Townsend & Banta

(57) ABSTRACT

A vehicle restraint system is provided, comprised of an easily installable and transportable base having a deployable vehicle retention means contained therein. In particular, a rigid base over which vehicles may drive is provided, having a deployable vehicle retention means, such as a net or flexible panel, disposed in the base. In addition, lockable rollers, deployable plates and tire puncturing devices are disposed in the base, to prevent or resist movement of the vehicle relative to the base. The base is merely laid upon a surface, and requires no mounting thereto. Upon impact with a vehicle, the vehicle is retained on the base, and the forward motion/inertia of the vehicle is depleted via frictional engagement (sliding) of the base over the mounting surface, wherein the base and vehicle come to a controlled stop within a short distance.

4 Claims, 9 Drawing Sheets

VEHICLE RESTRAINT SYSTEM

REFERENCE TO RELATED APPLICATION

This application is a corresponding non-provisional application and claims priority of provisional application Ser. No. 61/246,954, filed Sep. 29, 2009, the contents of which are incorporated herein by reference.

FIELD OF THE INVENTION

A vehicle restraint system is provided, which is comprised of an easily installable and transportable base having a deployable vehicle retention means contained therein. In particular, a rigid base over which vehicles may drive is provided, having a deployable vehicle retention means, such as a net or flexible panel, disposed in the base. In addition, deployable plates and tire puncturing devices are disposed in the base, to prevent movement of the vehicle.

BACKGROUND OF THE INVENTION

For many years, a small number of companies have sold vehicle crash barriers primarily designed to thwart deliberate vehicle-based attacks of buildings. These barriers are generally heavy steel structures imbedded in concrete or concrete structures in a road surface that physically obstruct the roadway. These heavy steel structure devices are designed so that a barrier device (usually a steel plate) can be raised or lowered to control the ability of a vehicle to pass through or over the barrier and, thus, gain access to the building being secured. These devices differ from the barriers commonly encountered in parking garages and other public venues, in that they have very high stopping power, for example, preventing a 15,000-pound explosive laden truck traveling at 50 mph from passing beyond the vehicle barrier.

Barriers come in numerous designs, but they can generally be categorized in three conventional types: plate, beam, and bollard. The plate barrier can be oriented to lay relatively flat on the surface of the roadway and be selectively actuated to be angled upwardly upon a perceived threat to form a wedge that restricts passage of a vehicle. The plate barrier is considered to be a permanently installed device as the plate is supported on a concrete encased frame that is buried into the surface of the roadway. A variation of the plate barrier has been introduced recently into the marketplace as a portable barrier. Another variation is to fasten the plate barrier to the roadway, such as with bolts. This barrier device is essentially a plate type barrier that is not imbedded in concrete, but instead can be moved to different locations to accommodate the need for temporary or changing security needs. Since the portable plate barrier is not imbedded in concrete, stopping power is relatively limited.

The beam barrier incorporates a vertically movable beam that is typically pivotally supported at one end of the beam by a steel support that is imbedded in concrete to provide a relatively immovable object and at the opposing end by a similar steel support at the opposing side of the roadway. The beam barrier serves as a movable gate that can be raised vertically (or swung horizontally) to allow vehicles to pass or lowered into engagement with the steel supports at either end of the beam to provide a substantial resistance to the passage of any vehicle. As with the conventional plate barrier, the beam barrier provides a permanent installation and relatively high stopping power. Some beam barriers use bands of nylon or similar material that are contained within the hollow beam and wrapped around the pivot structure for the beam to increase the resistance of the steel beam.

The bollards are typically permanently installed steel or concrete barriers that are typically not selectively movable, although vertical movement could be provided to permit the structure to rise into a passage restrictive position above the surface of the roadway, or be retracted into the ground to permit the passage of vehicles. Generally, bollards are a permanent structure that cannot be made portable without loss of substantial stopping power capabilities.

Conventional barriers generally have a disadvantage inherent in their designs in that each barrier design requires active mechanical movement of very heavy structures. Heavy steel plates (plate barriers) or heavy cylinders (bollard barriers) have to be raised against gravity in order to stop vehicles. Further, current vehicle barriers require approximately two seconds for emergency activation from an open position in which the vehicle can pass by the barrier to a deployed position in which a vehicle is prevented from passing by or over the barrier. Activation times for conventional beam barriers and sliding gate barriers are even longer, averaging about ten seconds for barriers that are one traffic lane wide and substantially longer for larger two lane barriers.

A vehicle traveling 50 mph covers 73 feet per second. Even if the barrier activation time is only two seconds, the facility needs to have almost 150 feet of standoff distance between the barrier close signal, such as from a guard or automated system, and the physical location of the barrier itself. Many facilities simply do not have the necessary space to accommodate this type of operation. This means that many existing barriers are seldom used in an "activate only when needed" mode. Thus, the barrier is always up and must be lowered for every authorized vehicle.

In addition, this constant raising and lowering of the vehicle barrier to allow authorized vehicle passage, over the course of its operating lifetime, requires a vehicle barrier to be cycled open and closed hundreds of thousands or even millions of times. Requiring constant movement from highly massive structures presents substantial challenges with respect to the maintenance and repair of vehicle barriers. Simply reducing the weight of the vehicle barrier is not a satisfactory resolution to these maintenance challenges as the stopping power of the vehicle barrier must be maintained.

With regards to the prevention of terrorist attack in ever-changing locations, such as roadblocks or military field installations, conventional barrier systems are generally impractical, as they require extensive installation procedures. In addition, such conventional barrier systems are often unable to stop a large terrorist vehicle, such as a 25,000-pound explosive laden trash truck, as has been employed in Lebanon, in a sufficient distance to prevent tremendous damage to the terrorist's intended target.

In view of the above mentioned disadvantages of conventional vehicle barrier systems, it is an object of the present invention to provide an improved vehicle restraint system that is highly portable, manufacturable at a lower cost than conventional systems, easily controllable, requires a low level of maintenance, yet is a highly effective barrier for security purposes.

SUMMARY OF THE INVENTION

In order to achieve the objects of the invention as described above, the present inventor earnestly endeavored to develop a vehicle restraint system capable of overcoming the disadvantages of the conventional vehicle barrier systems and vehicle restraint systems. Accordingly, a portable vehicle restraint system was developed, over which vehicles may pass freely until the system is actuated so as to deploy retention means therefrom, thereby securing the passing vehicle to the system and allowing the forward kinetic energy of the vehicle to be dissipated by sliding of the system relative to the ground.

In particular, the vehicle retention system of the present invention is comprised generally of a portable base, having a quickly deployable vehicle retention means movable disposed therein. To enable greater portability, the base may be provided in sections, which are then attached together on site. The vehicle retention means, such as netting, flexible polymer or fabric panels, etc., is attached to the base via quickly raisable retention means supports. These retention means supports may be a rigid or flexible column, spring, etc. In addition to retention means supports, which entrap the vehicle, lockable rollers are employed in the base, which may be unlocked and therefore allowed to rotate freely, preventing the vehicles tires from gripping a surface.

Moreover, exit prevention plates are movably disposed on the base, which prevent the vehicles tires from rolling forward or backward, thereby preventing exit of the vehicle from the system. And, as an optional embodiment, tire puncturing devices, such as deployable, tire piercing spikes, may be disposed on or embedded in the base and/or rollers, so as to allow an operator to deploy the spikes and puncture the tires of the intended vehicle.

As mentioned above, the system is highly portable, as the base may be loaded on a flatbed truck and simply laid on any desired surface. Thus, importantly, no extensive installation procedures are needed. Further, the system may be directly controlled via a wired or direct mechanical actuation means or, alternatively, a user may wirelessly control the deployment of the vehicle retention means via a wireless operator control unit (OCU) in wireless communication with the system. Therefore, an operator may stay at a safe distance from the system, while still maintaining a secure perimeter using the system of the present invention.

DETAILED DESCRIPTION OF THE INVENTION

Figure 1:
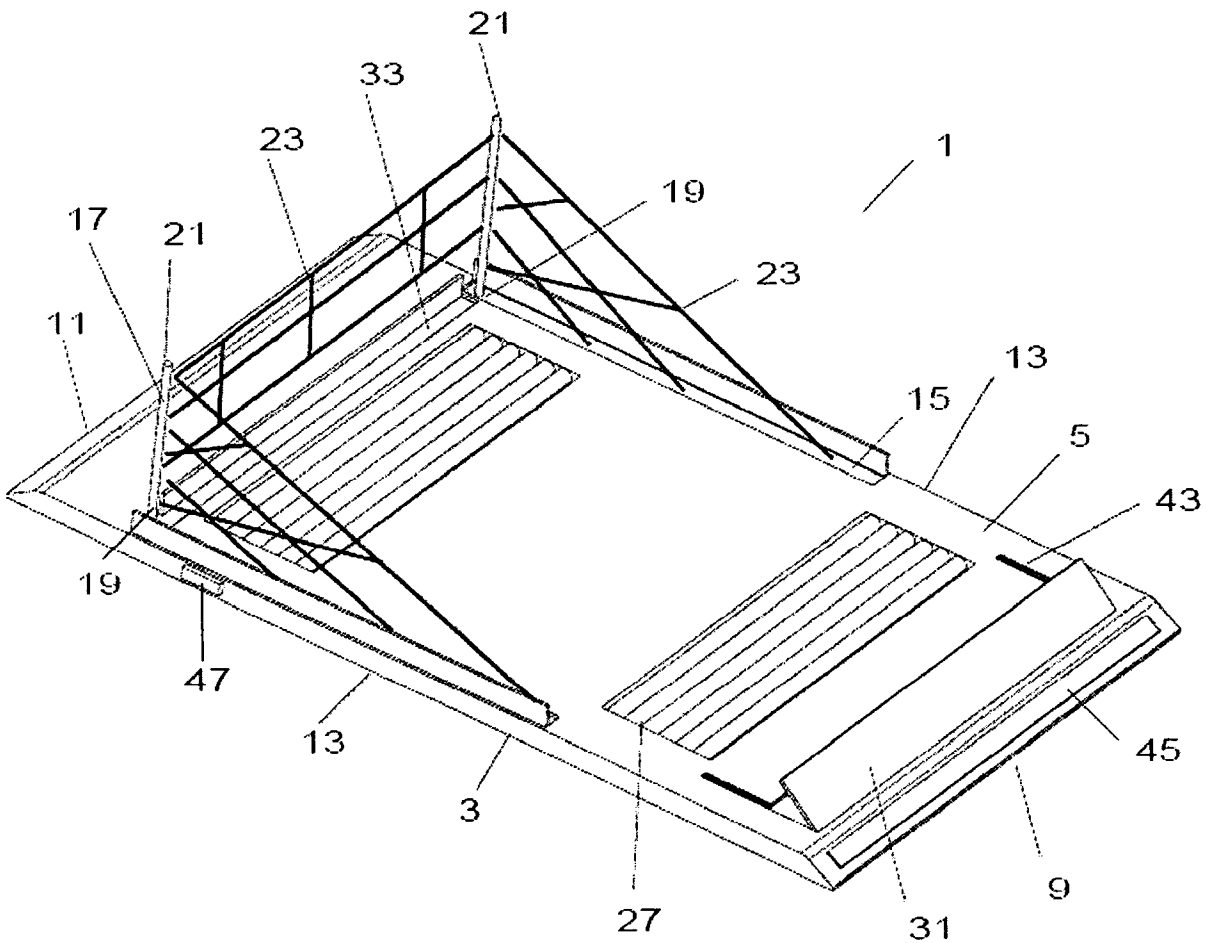
FIG. 1 is a perspective top view of the vehicle restraint system of the present invention, illustrating the orientation of the components of the system after deployment of the vehicle retention means and raising of the first and second exit prevention plates, wherein the vehicle retention means is flexible netting.
Figure 4:
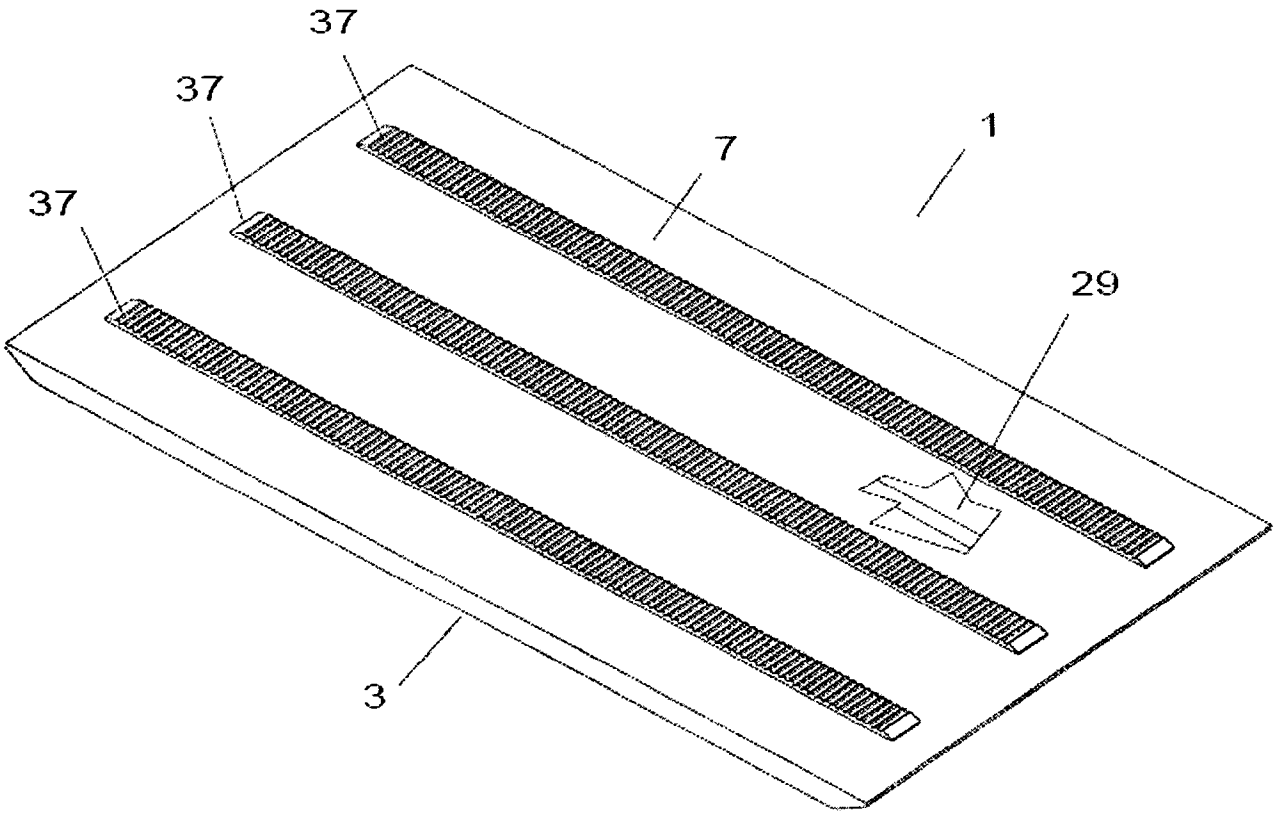
FIG. 4 is a perspective bottom view, partially cut away, of the vehicle restraint system of the present invention, illustrating the friction generating means that may be removably disposed on the bottom surface of the base, so as to increase friction between the base and surface upon which it rests, as well as the locking means utilized to lock the rollers in place.
Figure 9:
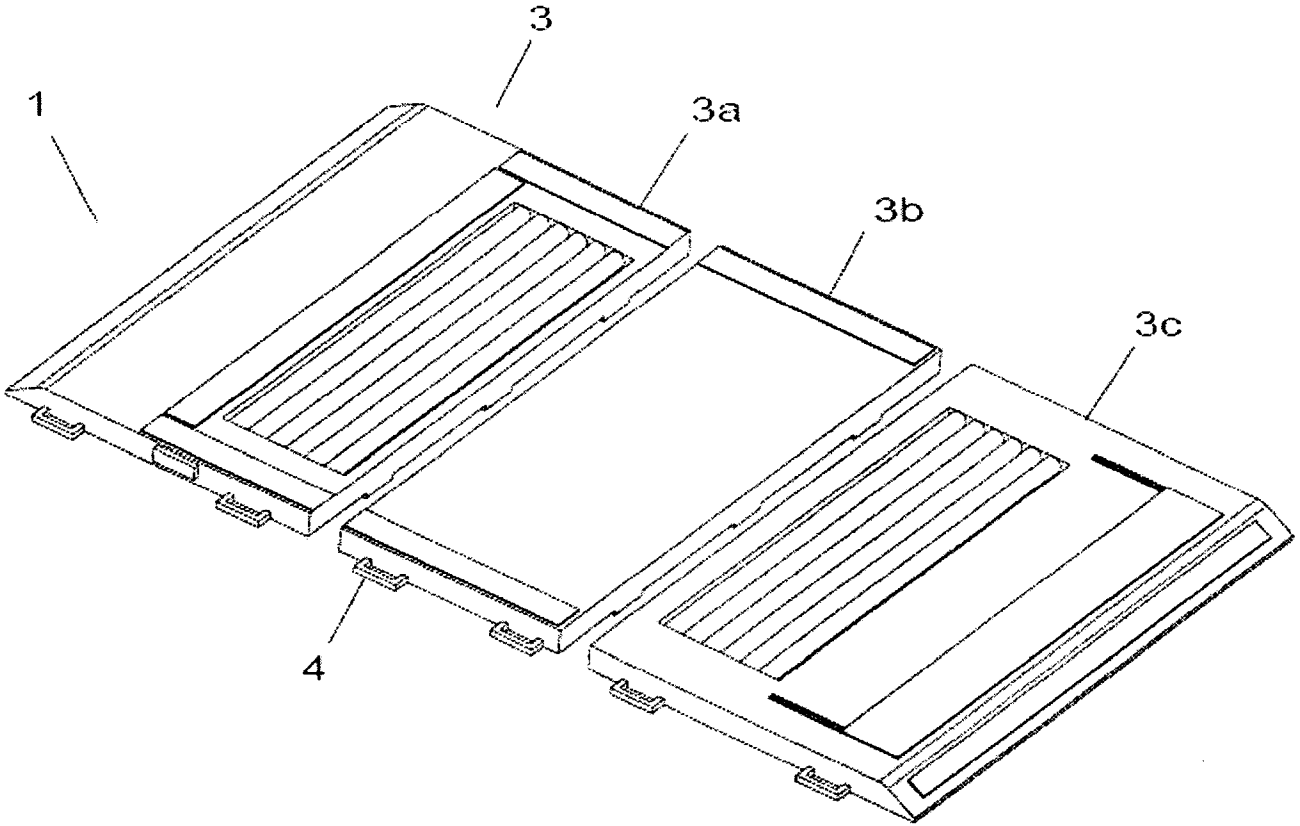
FIG. 9 is a top perspective view of the vehicle restraint system of the present invention, illustrating the multi-sectional embodiment of the base.

As illustrated in FIG. 1, the present invention provides a vehicle restraint system 1 comprised, generally of a base 3, retention means supports 17 movably attached to the base at the bottom portion 19 of the supports 17, and vehicle retention means 23 attached to the supports 17 and base 3. In particular, a base 3 is provided, having a top surface 5, a bottom surface 7 (as illustrated in FIG. 4), a first end 9, a second end 11, opposing sides 13, and slots 15 formed therein. The base 3 is preferably simply laid upon the installation surface, such as a roadway, and requires no further mounting procedures. To increase portability, as illustrated in FIG. 9, the base 3 may be formed in a plurality of sections 3*a*, 3*b*, 3*c*, which are then attached together via conventional means on site. Further, to ease handling, handles 4 may be attached to or formed integrally therewith.

The retention means supports 17, each having a bottom portion 19 and a top portion 21, are disposed in or adjacent to each of the slots 15, adjacent the second end 11 of the base 3. The supports 17 are disposed in movable engagement with the base 3, so as to allow the supports 17 to be retracted into the base 3, below the top surface 5 thereof. For example, the supports 17 may be attached via a simple hinge mechanism, or alternatively be comprised of one or more springs stored within the base in a compressed manner which, upon actuation, are freed to spring upwards and project above the top surface 5 of the base 3.

Figure 2:
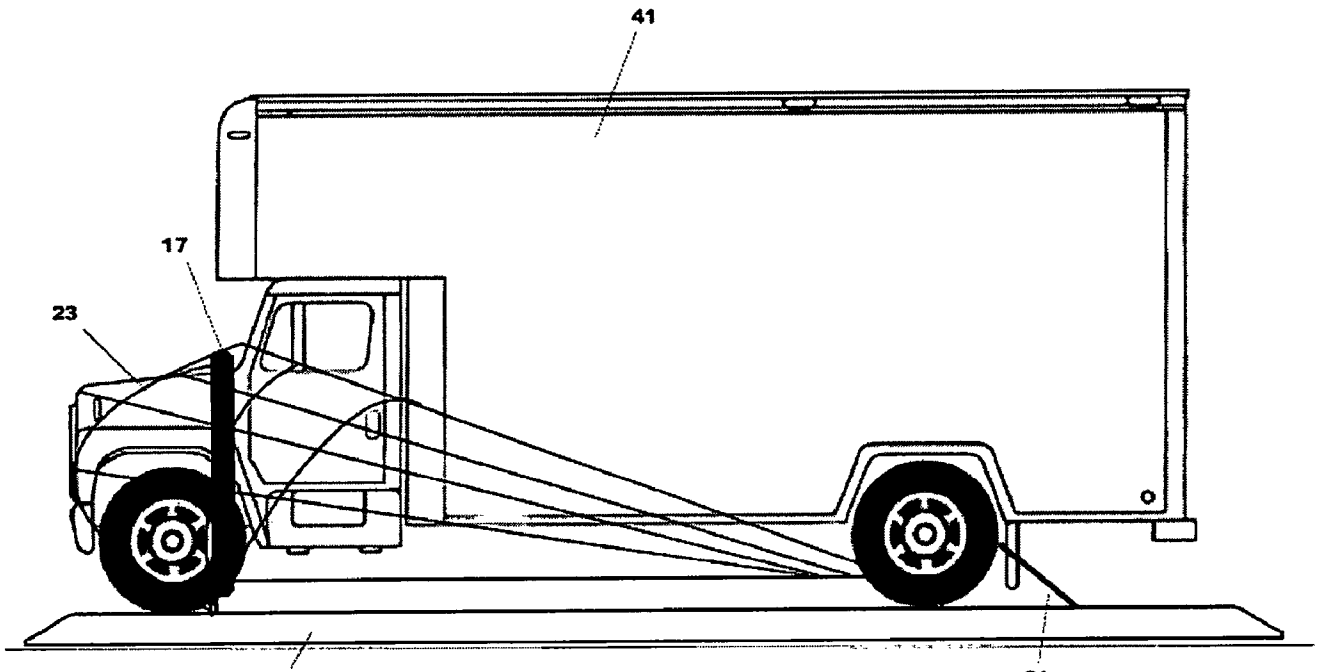
FIG. 2 is a side view of the vehicle restraint system of the present invention, illustrating a vehicle being restrained by the system.

The retention means supports 17 may be comprised of a rigid material, so as to retain their integrity during vehicle impact, as illustrated in FIG. 2. Alternatively, in a preferred embodiment, the supports 17 are comprised of one or more semi-rigid or flexible materials, such as plastics, polymers, rubbers, or a combination thereof, such that the retention means supports 17 may support the retention means 23 in an elevated manner, but flex when a vehicle impacts with the vehicle retention means 23.

Figure 5:
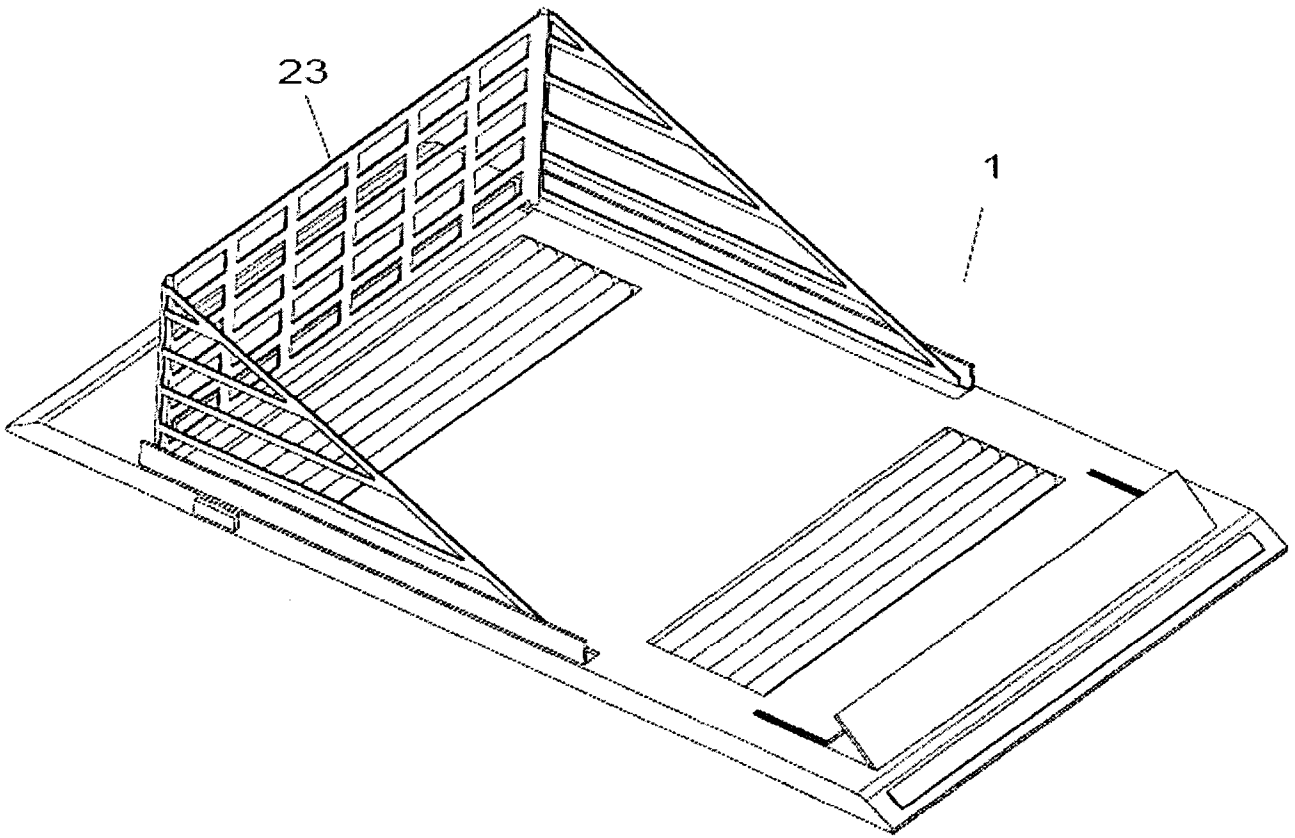
FIG. 5 is a perspective top view of the vehicle restraint system of the present invention, in which the vehicle retention means is comprised of a polymeric material having perforations therethrough.
Figure 6:
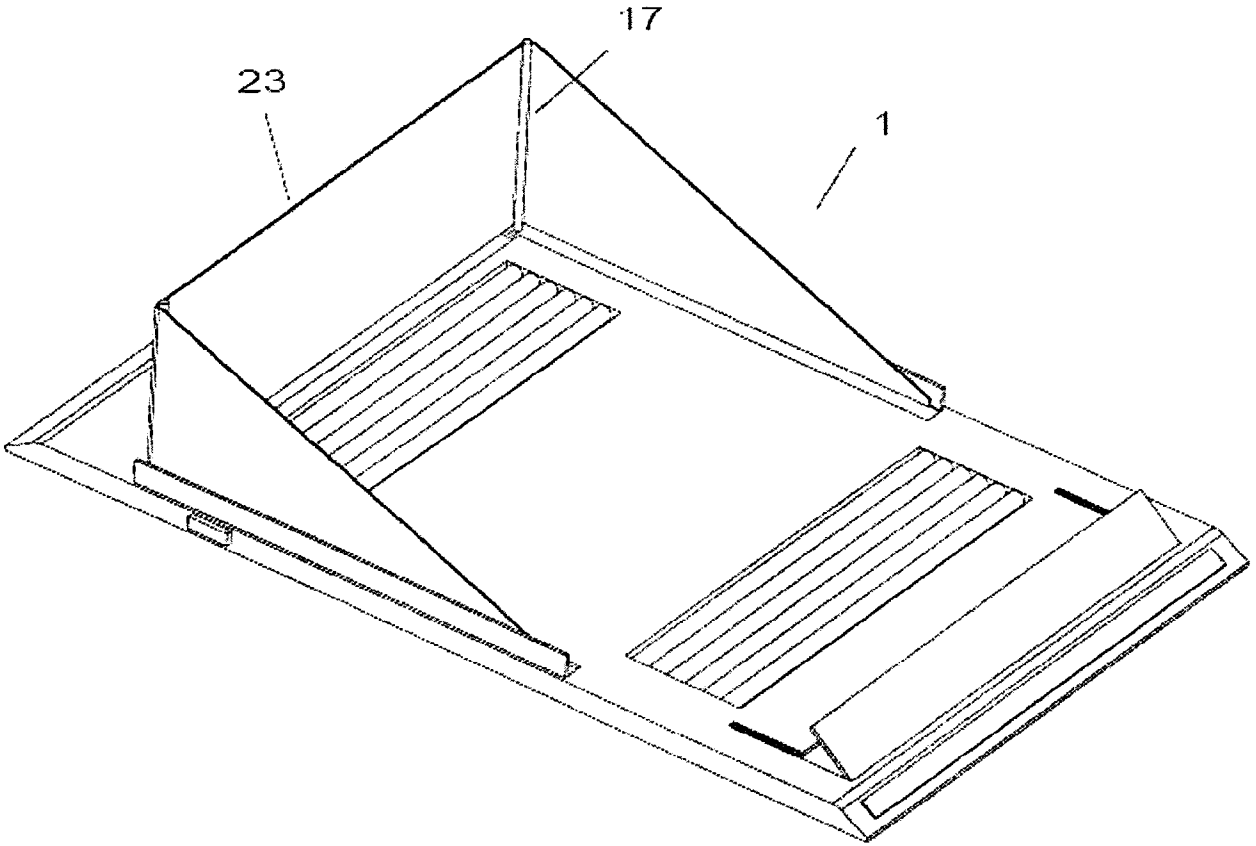
FIG. 6 is perspective top view of the vehicle restraint system of the present invention, in which the vehicle retention means is comprised of a flexible panel of polymeric, plastic or rubber material.

As illustrated in FIGS. 1 and 2, the vehicle retention means 23 is comprised of one or more of a cable, mesh, or netting. Such cable, mesh, or netting is formed of a plastic or polymer, Kevlar, nylon, a metal, or a combination of same. In an alternative embodiment, as illustrated in FIGS. 5 and 6, the vehicle retention means 23 may be formed of a perforated or solid panel of material, such as a flexible plastic or polymer sheet. In either event, preferably, the vehicle retention means 23 is formed of a material which is flexible in nature, but which is high breaking/tearing strength. Importantly, the material is to be chosen such that it can withstand the vehicle impact, while retaining the vehicle until the inertia thereof is dissipated by the friction between the base and the surface upon which is rests.

An actuation means (now shown) is provided in communication with the retention means supports 17, such that the actuation means are capable of controlling movement of the retention means supports relative to the base. The actuation means may be one or more of a mechanical actuation device, an electromechanical device, a propellant-charged device, or a combination of same. Importantly, the actuation means is capable of quickly propelling the supports 17 upwards relative to the base, so as to retain the vehicle retention means 23 in an orientation capable of retaining a vehicle, as illustrated in FIG. 2.

Figure 7:
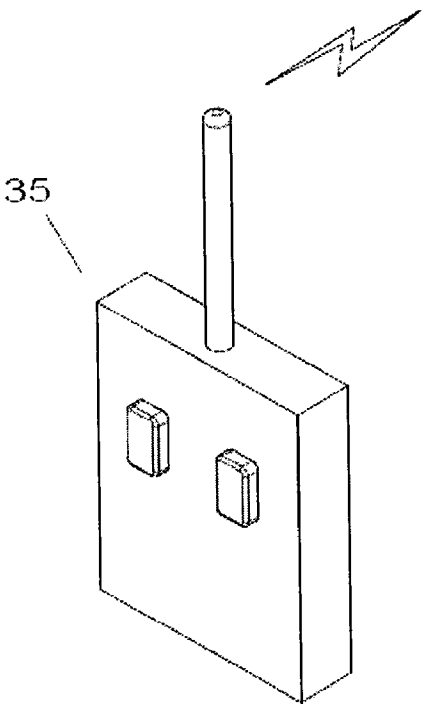
FIG. 7 is a perspective view of the operator control unit (OCU) by which an operator may wirelessly control the system of the present invention, via communication with the actuation control interface means.

The actuation means may be actuated by a user via an actuation control interface means 47, as illustrated in FIG. 1. Such interface 47 may be a simple conventional mechanical interface, wherein a user switches a switch, pulls a cord, etc., so as to actuate the actuation means. Alternatively, the interface means 47 may be comprised of a simply logic device or computer processor in communication with the actuation means, and a wireless communication means, so as to allow a user to control the actuation means 25 remotely, via a wireless capable operator control unit 35, as illustrated in FIG. 7. Such remote wireless capability enables users of the system 1 to maintain a safe operating distance from the system 1, providing a high degree of operational safety.

Figure 8:
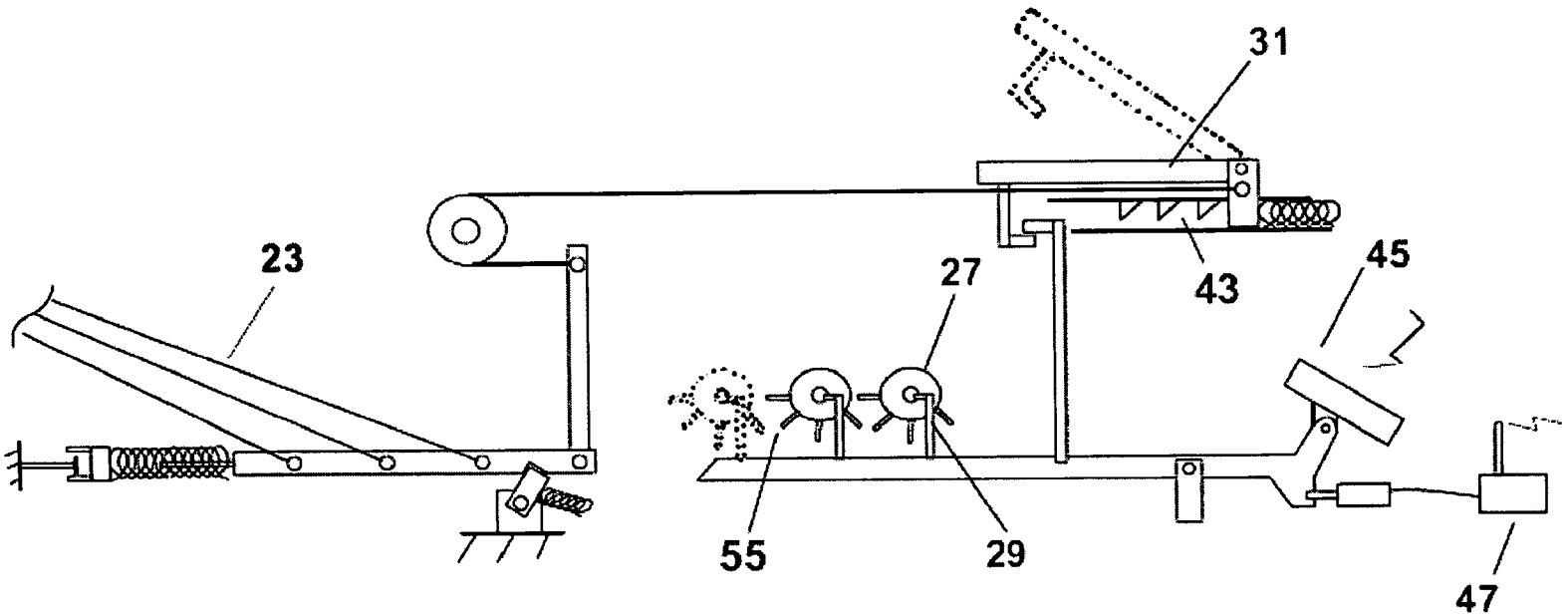
FIG. 8 is a partial side view, cut away, of the vehicle restraint system of the present invention, illustrating the connectivity of the vehicle retention means with the first exit prevention plate, the connectivity of the first exit prevention plate with the ratcheted slide rails, the locking means operable to prevent rotation of the rollers, the tire puncturing devices integrated into the rollers, and the communication of the OCU (shown in FIG. 7) with the pressure sensor plate.

As illustrated in FIGS. 1, 3, 5, 6, 8 and 9, in an preferred embodiment, a plurality of rollers 27 are disposed on or in the base, level with or slightly below the top surface 5 of the base 3, and in rotatable connection therewith. Although there is no limitation as to where the rollers 27 are disposed, preferably, the rollers 27 are disposed adjacent the first end 9 and second end 11 of the base 3, such that the tires of passing vehicles may be in alignment therewith. As illustrated in FIG. 8, to prevent rolling of the rollers 27 during operation, locking means 29 may be disposed in communication with the rollers 27.

Figure 3:
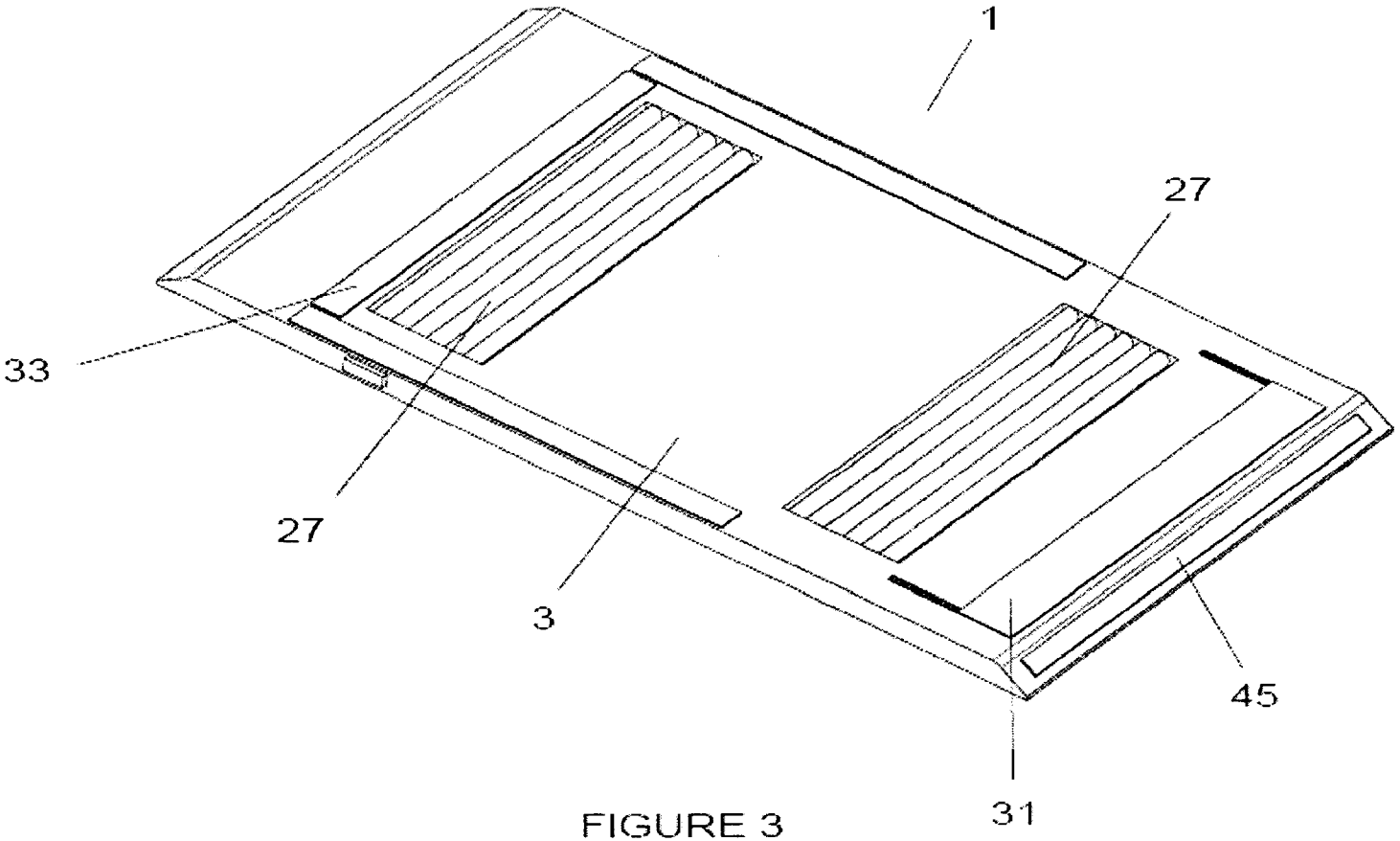
FIG. 3 is a perspective top view of the vehicle restraint system of the present invention in a non-deployed state, i.e., wherein the vehicle retention means, exit prevention plates, and tire puncturing devices have not been raised relative to the base. In this state, vehicles may pass over the base without incident.

By locking the rollers 27, vehicle may pass unimpeded over the base 3. However, when a threatening vehicle is detected, and the supports 17 raised, the locking means 29 may be unlocked into a rollable state either automatically through connection with the actuation means 25, supports 17, vehicle retention means 23, or via a command received directly or indirectly from the OCU 35. In this rollable state, vehicle tires spin freely without traction when resting upon the rollers, thereby impeding movement of the vehicle relative to the base 3. As a further means of preventing a vehicle from moving relative to the base 3, as illustrated in FIGS. 1 and 2, a first exit prevention plate 31 is provided in hinged connection with the base 3 adjacent the first end 9 thereof. As illustrated in FIG. 3, during normal operation wherein vehicle are permitted to freely pass over the system 1, the first exit prevention plate 31 is retracted into a downward orientation, so as to be flush with the top surface 5 of the base 3. However, as illustrated in FIG. 2, when a threat is detected, the first exit prevention plate 31 may be raised relative to the top surface of the base 3, thereby preventing or resisting exit of a vehicle 41 from the system 1 by obstruction of the tires thereof.

In a preferred embodiment, as illustrated FIG. 8, the first exit prevention plate 31 may be in mechanical communication with the vehicle retention means 23, such that when the retention means supports 17 are actuated, resulting in the raising of the vehicle retention means 23 relative to the base 3, and the vehicle impacts with the retention means 23, the vehicle retention means exert a forward pulling force on the first exit prevention plate 31. This forward pulling force is translated via a pulley or geared system into a force operable to elevate the plate 31 into an obstructive position.

In a further preferred embodiment, as illustrated in FIGS. 2 and 8, the first exit prevention plate 31 is in slidable communication with the base 3 via one or more ratcheted slide rails 43. As illustrated in operation in FIG. 2, by providing ratchets integral with, on or in communication with the sliding rails, the plate 31 is permitting to slide forward, from adjacent the first end 9 of the base towards the second end 11, until the plate 31 rests against the tires of vehicle 41. However, the one-way ratchets prevent the plate 31 from moving back towards the first end 9, thereby preventing the vehicle from backing up and off of the base 3.

Alternatively, the first exit prevention plate 31 may be disposed in communication with the actuation means, such that the actuation means is operable to raise the first exit prevention plate relative to the base. In such an alternative embodiment, the plate 31 is in communication with actuation means is operable to directly raise the plate 31. However, a second actuation means, such as an electric, hydraulic or pneumatic motor, may be provided solely for the raising and lowering of the plate 31. Such second actuation means is preferably in communication with the interface means 47 and/or the OCU 35.

In addition to the first exit prevention plate 31, as illustrated in FIGS. 1 and 3, a second exit prevention plate 33 is provided in hinged connection with the base 3 adjacent the second end 11 thereof. Like the first exit prevention plate 31, this second exit prevention plate 33 may be raised relative to the top surface of the base, thereby preventing or resisting exit of a vehicle from the system adjacent the second end 11 thereof. Further, like the first exit prevention plate 31, the second exit prevention plate 33 may be in communication with the retention means supports, the actuation means, the interface means 47, and/or the OCU 35, etc., so as to raise same automatically or upon command.

In an optional embodiment, as illustrated in FIGS. 1, 3 and 8, a pressure sensor 45 may be disposed at or adjacent to the first end 9 of the base 3, and in communication with the actuation means and/or the actuation control interface means 47. In particular, the pressure sensor 45 may be disposed so as to sense contact of a vehicle with the base 3. When sensing contact of a vehicle, the pressure sensor 45 may be configured to cause the supports 17 to be raised, the exit prevention plates 31, 33 to be locked in a timed fashion, the rollers 27 to be unlocked, etc. Further, the pressure sensor may be directly activated/deactivated by a user, or remotely activated/deactivated via the OCU 35, as illustrated in FIG. 8.

As mentioned above, the system 1 may be simply laid upon the desired surface, such as roadway, checkpoint, building entrance, military base entrance, etc., and thus desirably requires no technical installation procedures. When a threatening vehicle is retained in the retention means 23, as illustrated in FIG. 2, the kinetic energy/inertia of the vehicle is dissipated by frictional interaction of the base 3 with the surface upon which is rests. Therefore, the base 3 is permitted to slide relative to the ground, so as to stop the vehicle 41 in a controlled manner. In order to increase the friction between the base 3 and the support surface, as illustrated in FIG. 4, one or more friction generating structures 37 may be disposed on or integral with the bottom surface 7 of the base 3. These friction generating structures 37 may be comprised of metal, polymer, rubber, or a combination thereof, but any material that is suitable to create friction between the surface upon which the system 1 shall be placed is acceptable. Preferably, the friction generating structures 37 are removably connected to the base, so as to allow replacement thereof when they are worn down through use, or are to be replaced with another device structure/material more suitable to the intended application.

As illustrated in FIG. 8, in a preferred embodiment, a further vehicle impediment is provided, namely tire puncturing devices 55. In particular, one or more tire-puncturing devices 55 may movably disposed on or within the base 3 and/or rollers 27, and in communication with one or more of the actuation means, pressure sensor 45, interface means 47, and OCU 35. These tire-puncturing devices, when deployed into an orientation protruding above the top surface 5 of the base 3, are capable of puncturing a tire of a vehicle upon impact therewith. These tire-puncturing devices 55 may take many forms, but preferably are one or more of mechanically-deployed spikes, hydraulically deployed spikes, pneumatically-deployed spikes, or pyrotechnically deployed spikes.

Although specific embodiments of the present invention have been disclosed herein, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

List of Drawing Elements:

1: vehicle restraint system
3: base
5: base top surface
7: base bottom surface
9: base first end
11: base second end
13: base sides
15: base slots
17: retention means supports
19: retention means support bottom portion
21: retention means support top portion
23: vehicle retention means
27: rollers
29: locking means
31: first exit prevention plate
33: second exit prevention plate
35: operator control unit (OCU)
37: friction generating structures
41: vehicle
43: ratcheted slide rails
45: pressure sensor
47: actuation control interface means
55: tire puncturing devices

What is claimed is:

1. A vehicle restraint system comprising:

(a) a base having a top surface, a bottom surface opposite the top surface, a first end, a second end opposite the first end, two sides disposed between the first end and the second end, and one or more slots disposed in the base adjacent each of the two sides thereof;

(b) one or more retention means supports, each of said supports having a bottom portion and a top portion, the one or more retention means supports disposed in or adjacent to each of the one or more slots and adjacent the second end of the base and being in movable engagement with the base;

(c) vehicle retention means attached to the retention means supports, and to the base in or adjacent to the slots;

(d) an actuation means in communication with the retention means supports, said actuation means operable to control movement of the retention means supports relative to the base; and (e) a plurality of rollers disposed on or in the top surface of the base, and in rotatable connection therewith, wherein, when actuated, the actuation means extends the retention means supports beyond the top surface of the base, thereby raising the vehicle retention means into a position capable of interacting with a vehicle passing over the vehicle restraint system.

2. The vehicle restraint system of claim 1, further comprising:

a locking means in communication with the plurality of rollers and the base, wherein the locking means is operable to lock the rollers into a non-rollable state relative to the base, so as to allow vehicle movement over said rollers without impedance of said movement by rotation of the rollers.

3. The vehicle restraint system of claim 2, further comprising:

a first exit prevention plate in hinged connection with the base adjacent the first end thereof, such that the first exit prevention plate may be raised relative to the top surface of the base, thereby preventing or resisting exit of the vehicle from the system, wherein the first exit prevention plate is in communication with the vehicle retention means, such that when the retention means supports are actuated, resulting in raising of the vehicle retention means relative to the base, the vehicle retention means exert a force upon the first exit prevention plate operable to raise the first exit prevention plate relative to the base.

4. The vehicle restraint system of claim 3, further comprising:

one or more ratcheted slide rails disposed on or in communication with the base, and in slidable communication with the first exit prevention plate, said one or more ratcheted slide rails comprising a plurality of one-way ratchets thereon, wherein force exerted by the vehicle retention means acts to slide the first exit prevention plate forward towards the second end of the base along the one or more ratcheted slide rails, so as to cause the first exit prevention plate to move against or adjacent to one or more tires of the vehicle when the vehicle interacts with the vehicle retention means.

* * * * *